United States Patent [19]

Murray

[11] Patent Number: 4,959,881

[45] Date of Patent: Oct. 2, 1990

[54] CLEANING MITT

[76] Inventor: Ellen E. Murray, 239 Pine Drive, Barrie, Ontario, Canada, L4N 4H6

[21] Appl. No.: 492,410

[22] Filed: Mar. 8, 1990

Related U.S. Application Data

[63] Continuation of Ser. No. 292,943, Jan. 3, 1989, abandoned.

[51] Int. Cl.[5] ..... A47L 1/15

[52] U.S. Cl. ..... 15/227; 15/104.94; 2/158; 206/278; 294/1.3

[58] Field of Search ..... 15/104.93, 104.94, 227, 15/210 R, 244.3, 247, 208; 401/7; 206/438, 278, 210; 2/158, 159, 160, 161 A, 161 R, DIG. 2; 294/1.3

[56] References Cited

U.S. PATENT DOCUMENTS

| | | | |
|---|---|---|---|
| 1,643,722 | 9/1927 | Millen | 15/227 |
| 3,608,708 | 9/1971 | Storandt | 15/104.94 |
| 4,051,572 | 10/1977 | Greenwood | 15/227 |
| 4,071,921 | 2/1978 | Jury | 15/227 |
| 4,788,733 | 12/1988 | Lerner | 15/104.94 |

*Primary Examiner*—Harvey C. Hornsby
*Assistant Examiner*—Mark Spisich
*Attorney, Agent, or Firm*—Fetherstonhaugh & Co.

[57] ABSTRACT

A cleaning mitt is provided with a hand compartment proportioned to accommodate the hand of the user. A cleaning pad, which may be permeated with a cleaning solution, is mounted on the front face of the mitt. A cover is also secured to the front face of the mitt covering the cleaning pad. In use the cover is removed from its position covering the pad, thus exposing the pad for use as a cleaning implement. Features such as outer and inner tabs to aid in removal of the cover from the mitt and the mitt from the hand may be provided. Also outer and inner cuffs may form pockets that aid in the convenient and sanitary disposal of the mitt.

6 Claims, 3 Drawing Sheets

CLEANING MITT

This application is a continuation of application Ser. No. 292,943, filed Jan. 3, 1989, now abandoned.

FIELD OF THE INVENTION

This invention relates to cleaning mitts and, in particular, to a cleaning mitt which serves to permit the user to avoid contact with the surfaces which are to be cleaned and the substances which are removed during the cleaning operation and which may remain in contact with the cleaning mitt.

BACKGROUND OF THE INVENTION

Various implements for cleaning and disinfecting surfaces have, of course, long been known. Most of those prior devices have involved dipping or soaking device in a cleaning solution prior to use. In addition, where the device has been held directly in the hand in use, the hand is often been covered by a glove or mitt to avoid any contact with both the surface to be cleaned and the disinfectant solution.

Canadian Pat. No. 1,062,403 discloses a cleaning glove carrying a pile surface on at least one of its outer surfaces. However, the glove of Pat. No. 1,062,403, unlike the present invention, has no form of covering for the pile surface prior to use. The pile surface is not permeated with a cleaning or disinfecting solution prior to use.

The primary user of a cleaning implement is usually aware of the fact that the soiled portions of the cleaning implement may be hazardous or undesirable, however, a subsequent handler may be quite unaware of the nature of the contamination and may not take adequate care in the handling of the soiled cleaning implement.

I have found that I can provide a cleaning mitt in which the hand covering, cleaning implement and cleaning solution may all be contained in one device. Also, the mitt may be compact and may be folded or rolled so as to be easily transportable in a pocket or handbag either individually or in a package of several mitts. As well, the mitt will be disposed of after use and no cleaning for re-use is therefore necessary. The cleaning and disinfectant solution with which the device is permeated may be formulated to dry rapidly when in contact with air, therefore allowing almost immediate use of the surface cleaned after cleaning. Another advantage to this invention is that, after use, the mitt can be turned inside out and bundled in such a manner that the portion of the mitt that has been in contact with the area cleaned is entirely out of direct contact with the user's hand. The mitt may then be safely and conveniently stowed in the hand or in a pocket in the event that it cannot readily be disposed of.

SUMMARY OF THE INVENTION

The cleaning mitt of the present invention provides a simple and efficient aid for cleaning a variety of surfaces such as toilet seats in public washrooms prior to use. This device will be of particular benefit in light of the increase in awareness regarding sanitation and the prevention of the spread of disease.

According to one aspect of the present invention, there is provided a cleaning mitt assembly comprising a mitt having a hand compartment formed therein which is proportioned to accommodate the hand of the user, said mitt having a front face, a cleaning pad mounted on the front face of said mitt and a pad sealing cover secured to the front face of the mitt in a releaseable manner, said cover being arranged to co-operate with the front face of the mitt to form an enclosure about the cleaning pad, said cover being removable from its position covering the cleaning pad to expose the cleaning pad in use.

BRIEF DESCRIPTION OF THE DRAWINGS

In drawings which illustrate embodiments of the invention,

FIG. 5(*b*) is a cross-section through the mitt illustrating a second manner of folding for disposal;

DESCRIPTION OF PREFERRED EMBODIMENT

Figure 1:
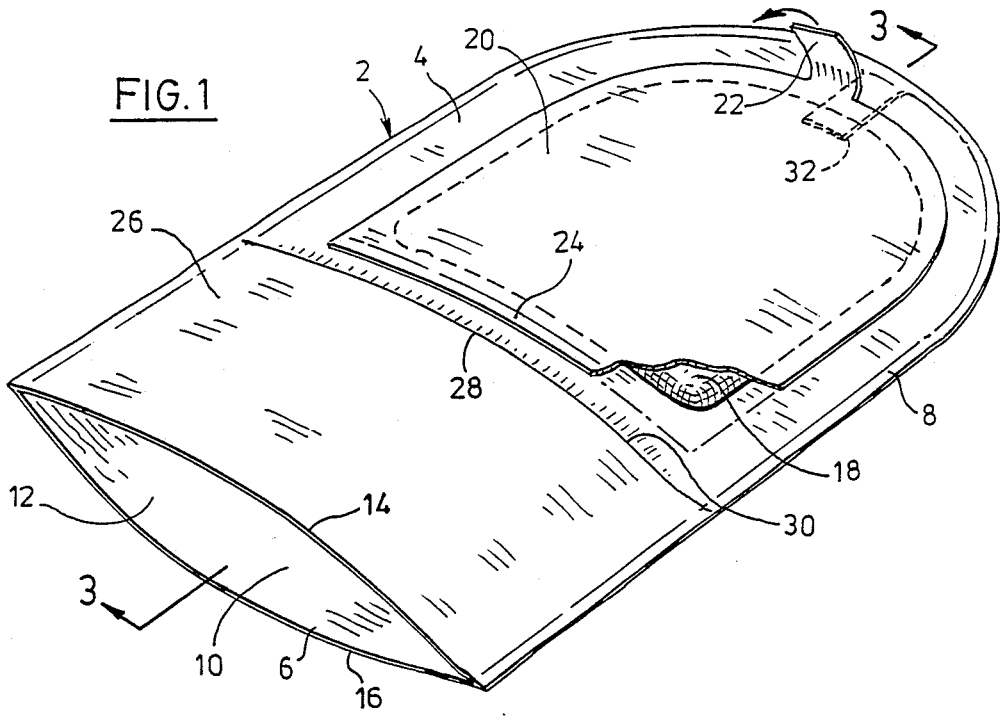
FIG. 1 is a plan view of the mitt.

With reference to FIG. 1 of the drawings, the reference numeral 2 refers generally to a mitt which is constructed in accordance with an embodiment of the present invention.

The mitt 2 is formed from two panels of a liquid-impermeable material such a plastics material. The front panel 4 and the back panel 6 are sealed together at the edges 8 to form a hand compartment 10 that is large enough to accommodate the user's hand. The front panel 4 and back panel 6 remain unsealed along the proximate edges 16 and 14 thus providing an opening 12 whereby the hand may enter the mitt 2. When in place, the user's fingers will extend toward the distal portion of the mitt while the proximal portion will surround the user's wrist.

An absorbent cleaning pad 18 is located generally in the forward half of the distal portion front face of the front panel 4 and is secured by means of an adhesive or the like to the panel 4. The cleaning pad is preferably permeated with a cleaning and disinfecting solution. Where the solution is moist, it is formulated so as to dry quickly when exposed to air. The pad 18 may be formed of any material with absorbent qualities.

Figure 2:
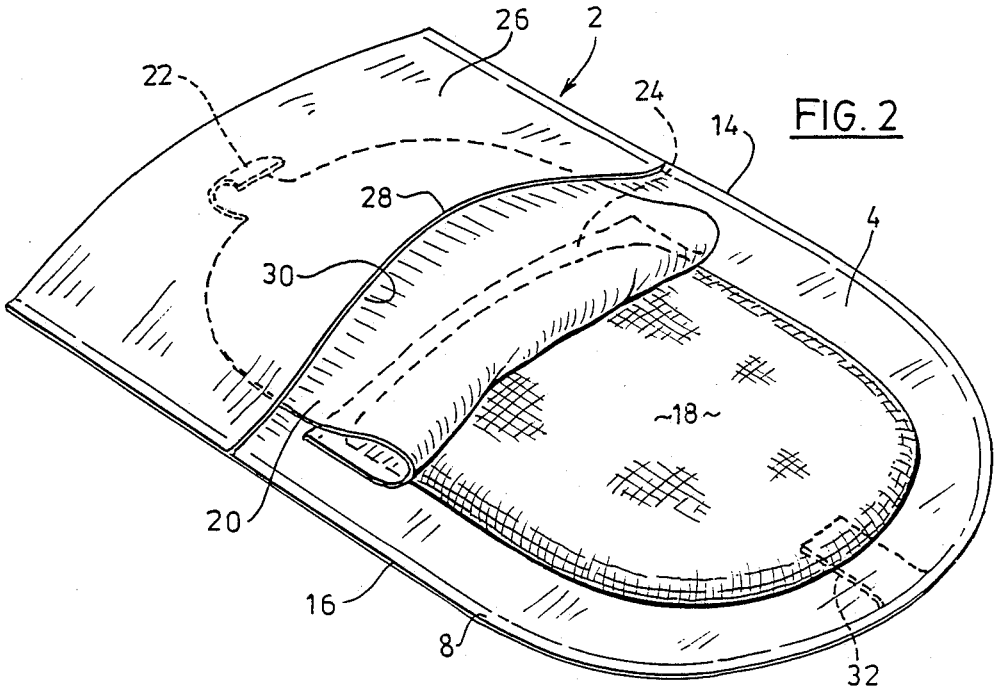
FIG. 2 is a plan view of the mitt illustrating removal of the panel.

A protective pad sealing cover 20 covers the pad 18 and is adhered to the front face of the mitt in a manner such that it can be peeled away from the front panel 4 with a minimum of force but forms an air and liquid-impermeable seal around the pad 18 when in place. The distal end of the cover 20 is formed into a projecting tab 22 that is free of attachment to the front panel 4 and provides a point at which the pad sealing cover 20 can be grasped and peeled away from the front panel 4 to uncover the pad 18. The cover 20 is thus peeled away starting at the distal end and moving toward the proximal end and is then discarded. Various modifications of the mitt of the present invention will be apparent to those skilled in the art. In one modification, the proximal border 24 may remain attached to the front panel 4, in which case an outer cuff 26 is provided. The outer cuff 26 is located at the proximal end of the front panel 4 and is secured to the front panel 4 except along the edge 28 of the outer cuff 26 bordering the pad 18 and cover 20 where it is free of attachment, thus forming an outer pocket 30 into which the panel 20 can be folded when it is peeled away from the pad 18 as is shown in FIG. 2.

A free-hanging tab 32 is located within the hand compartment 10 and extends from the inner surface of the distal end of the mitt 2. After use of the mitt, the tab 32 is grasped by the fingers of the user in the mitt 2 and a portion of the proximal end of the mitt 2 is grasped by the other hand. The mitt 2 may then be turned inside out and discarded. By turning the mitt inside out in this manner, the soiled cleaning pad can be enclosed before it is discarded.

Figure 3:
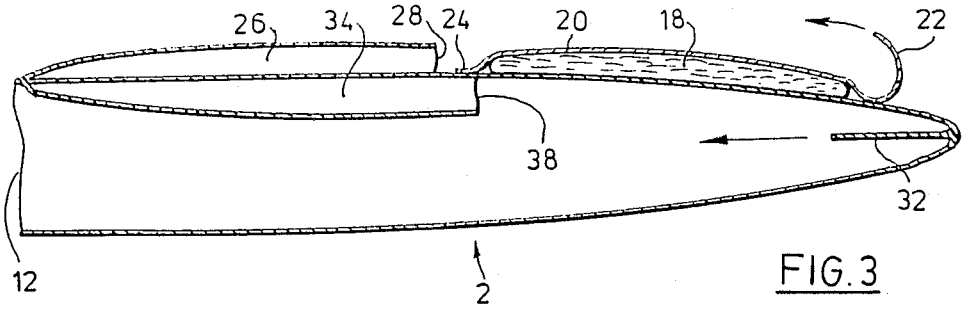
FIG. 3 is a cross-section through the mitt with the cover secured in place over the cleaning pad.
Figure 4:
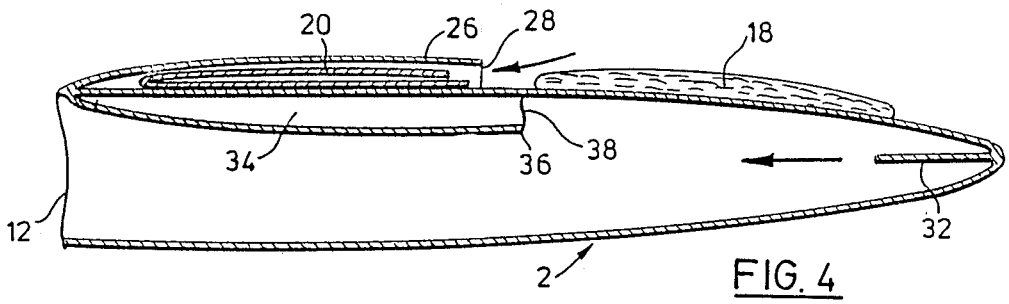
FIG. 4 is a cross-section through the mitt with the cover removed from the cleaning pad and folded into the outer cuff.
Figure 5A:
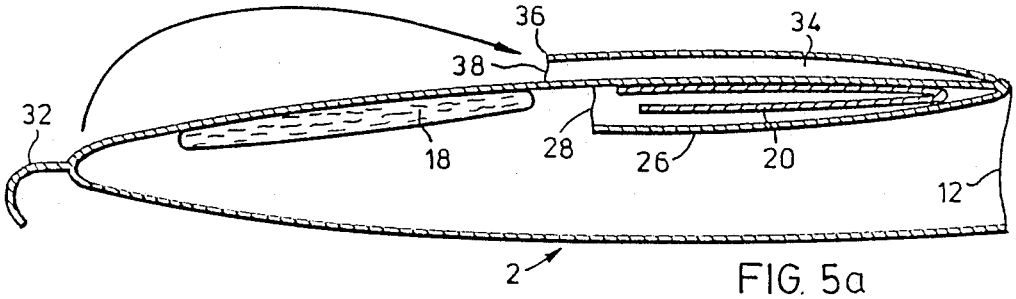
FIG. 5(*a*) is a cross-section through the mitt illustrating a manner of folding for disposal.
Figure 6:
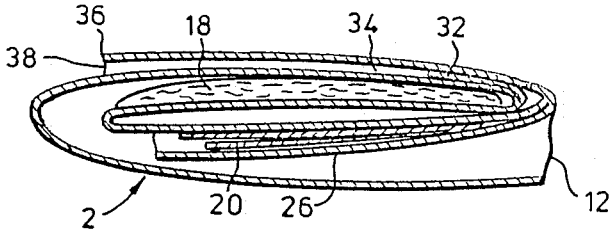
FIG. 6 is a cross-section through the mitt folded for disposal in the manner of FIG. 5(*a*)
Figure 5B:
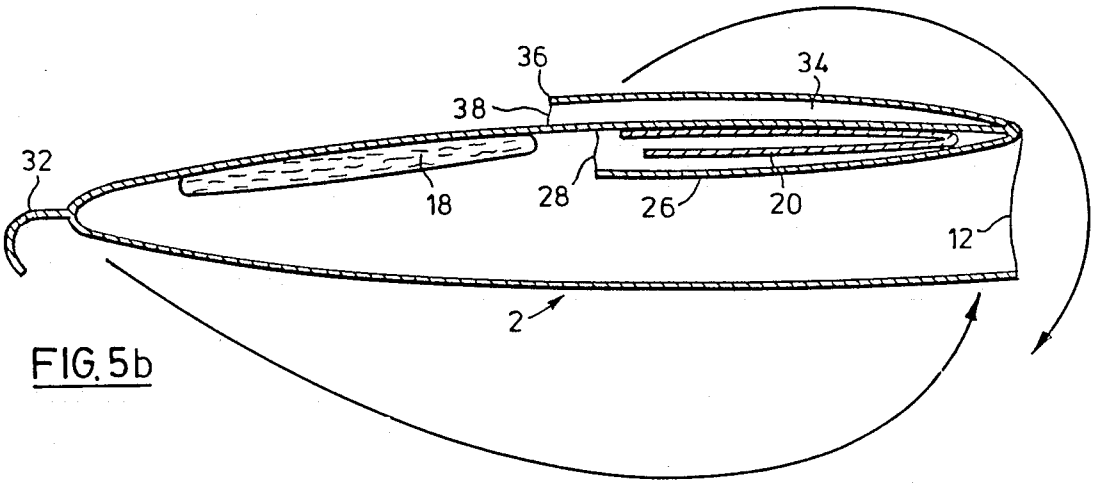
Figure 8:
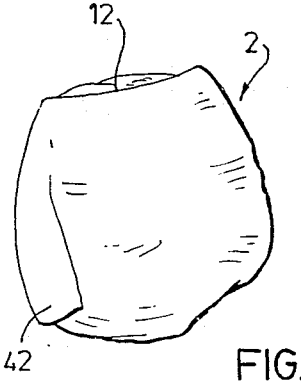
FIG. 8 is a view of the mitt bundled for disposal.
Figure 7:
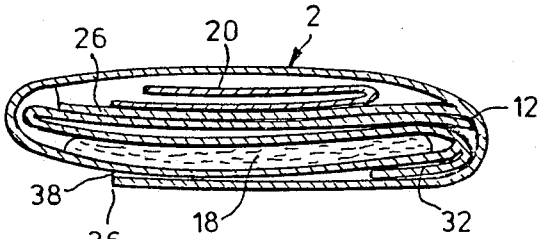
FIG. 7 is a cross-section through the mitt folded for disposal in the manner of FIG. 5(*b*)

As is illustrated in FIGS. 3 and 4, an inner cuff 34 is located in the proximal portion of the inner face of the front panel 4. As with the outer cuff 26, the inner cuff 34 is attached to the front panel except along the distal border 36 where it is free of attachment, thus forming an inner pocket 38. The entire mitt 2 can be folded into this pocket 38 after use. After the mitt 2 has been turned inside out, the distal half of the mitt 2 can be folded as indicated by the directional arrow in FIG. 4 and tucked into the inner pocket 38 for more compact and convenient disposal. Alternatively, the mitt 2 may be folded as shown by the lower directional arrow in FIG. 5(*b*) and the inner pocket then folded back in the direction of the upper directional arrow of 5(*b*). The entire mitt 2 is then folded into the reversed inner pocket 38, thus providing a convenient bundle for disposal as shown in FIG. 8. This bundle will also have the advantage of minimizing contact with any leakage that might occur from pad deposits prior to disposal.

I claim:

1. A cleaning mitt assembly comprising:

(a) a mitt having a hand compartment formed therein which is proportioned to accommodate the hand of the user with a proximal end through which an access passage opens into the hand compartment and a distal end remote from the promixal end, said mitt having a front face;

(b) a cleaning pad mounted on the front face of said mitt, said cleaning pad being of a size that is smaller than the area of the front face of said mitt;

(c) a pad sealing cover releasably secured to the front face of the mitt in close proximity to the cleaning pad, said cover being arranged to cooperate with the front face of the mitt to form an enclosure about the cleaning pad, said cover being removable from its position covering the cleaning pad to expose the cleaning pad in use; and, (d) an outer pocket located at the proximal end thereof which opens toward said distal end, said outer pocket being proportioned to accommodate the said pad sealing cover after removal of the cover from its position covering the cleaning pad.

2. The cleaning mitt of claim 1 wherein a tab is located within the hand compartment and extends from the inner distal portion of the mitt such that it may be grasped by the wearer when the wearer's hand is being withdrawn to cause the mitt to turn outside in to locate the pad inside the mitt.

3. The cleaning mitt of claim 1 wherein an inner pocket is provided within the mitt, said inner pocket being proportioned to accommodate the mitt when it is turned inside out and folded for disposal, said mitt being sufficiently flexible to permit the inner pocket to be reversed and wrapped around the mitt when it is folded for disposal.

4. A cleaning mitt assembly comprising:

(a) a mitt having a hand compartment formed therein which is proportioned to accommodate the hand of the user with a proximal end through which an access passage opens into the hand compartment and a distal end remote from the proximal end, said mitt having a front face;

(b) a cleaning pad mounted on the front face of said mitt, said cleaning pad being of a size that is smaller than the area of the front face of said mitt;

(c) a pad sealing cover secured to the front face of the mitt in a releaseable manner, said cover being arranged to co-operate with the front face of the mitt to form an enclosure about the cleaning pad, said cover being removable from its position covering the cleaning pad to expose the cleaning pad in use; and, (d) an outer pocket located at the proximal end of the front face wherein said pad sealing cover may be folded after removal from its position covering the cleaning pad.

5. The cleaning mitt of claim 4 wherein an inner pocket is provided within the mitt adjacent to the outer pocket, said inner pocket being proportioned to accommodate the mitt when it is folded for disposal, said mitt being sufficiently flexible to permit the inner pocket to be folded inside-out to wrap around the mitt when it is folded for disposal.

6. A cleaning mitt assembly comprising:

(a) a mitt having a hand compartment formed therein which is proportioned to accommodate the hand of the user with a proximal end through which an access passage opens into the hand compartment and a distal end remote from the proximal end, said mitt having a front face;

(b) a cleaning pad mounted on the front face of said mitt, said cleaning pad being of a size that is smaller than the area of the front face of said mitt;

(c) a pad sealing cover secured to the front face of the mitt in a releasable manner, said cover being arranged to co-operate with the front face of the mitt to form an enclosure about the cleaning pad, said cover being removable from its position covering the cleaning pad to expose the cleaning pad in use; and, (d) an inner pocket located within the mitt at the proximal end of the front face thereof, said inner pocket being proportioned to accommodate the mitt when it is folded for disposal, said mitt being sufficiently flexible to permit the inner pocket to be folded inside-out to wrap around the mitt when it is folded for disposal.

* * * * *